US009033293B1

(12) United States Patent
Glenn et al.

(10) Patent No.: US 9,033,293 B1
(45) Date of Patent: May 19, 2015

(54) FURNITURE RISER

(71) Applicants: Matthew S. Glenn, Lincoln, NE (US); David L. Johnsen, Hickman, NE (US)

(72) Inventors: Matthew S. Glenn, Lincoln, NE (US); David L. Johnsen, Hickman, NE (US)

(73) Assignee: GLENN FAMILY, INC., Pawnee City, NE (US)

( * ) Notice: Subject to any disclaimer, the term of this patent is extended or adjusted under 35 U.S.C. 154(b) by 0 days.

(21) Appl. No.: 14/250,988

(22) Filed: Apr. 11, 2014

(51) Int. Cl.
*F16M 11/24* (2006.01)
*A47B 91/00* (2006.01)

(52) U.S. Cl.
CPC ..... *A47B 91/005* (2013.01)

(58) Field of Classification Search
CPC .... A47B 91/015; A47B 91/00; A47B 91/005; A47B 91/04; A47B 91/12
USPC ..... 248/188.2, 188.9, 346.04, 346.05, 248/346.5, 346.11; 5/658, 663
See application file for complete search history.

(56) References Cited

U.S. PATENT DOCUMENTS

| | | | | |
|---|---|---|---|---|
| 5,038,606 | A | 8/1991 | Geschwender et al. | |
| 6,012,185 | A * | 1/2000 | Woods et al. | 5/509.1 |
| 6,948,688 | B1 * | 9/2005 | Payne et al. | 248/188.2 |
| 7,152,468 | B1 | 12/2006 | Peterson | |
| 7,401,508 | B1 | 7/2008 | Peterson | |
| 7,536,907 | B1 | 5/2009 | Peterson | |
| 7,543,493 | B2 | 6/2009 | Geschwender | |
| 7,958,967 | B2 * | 6/2011 | Lambdin | 182/179.1 |
| 8,413,948 | B2 * | 4/2013 | Kemeny | 248/566 |
| 2001/0023509 | A1 * | 9/2001 | Becker et al. | 5/509.1 |

FOREIGN PATENT DOCUMENTS

WO WO 2004111366 A1 * 12/2004

* cited by examiner

*Primary Examiner* — Gwendolyn W. Baxter

(57) ABSTRACT

A furniture riser which may be stacked one upon another in a stackable fashion. The furniture riser may also be attached to an identical riser in a side-by-side manner.

8 Claims, 7 Drawing Sheets

FURNITURE RISER

BACKGROUND OF THE INVENTION

1. Field of the Invention

This invention relates to a furniture riser and more particularly to a stackable riser wherein identical risers may be stacked one upon the other. Further, this invention relates to a riser wherein a pair of the risers may be secured together in a side-by-side manner.

2. Description of the Related Art

Many types of furniture risers have been previously provided to enable furniture such as beds, desks and sofas to be raised above the floor. However, the prior art risers, when stacked one upon the other, tend to be less than stable and tend to tip over. Further, the prior art furniture risers are not able to be secured together in a side-to-side manner to stabilize the riser.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In the preferred embodiment, the furniture riser includes a generally horizontally disposed top wall having a first end, a second end, a first side and a second side. A first end wall, having upper and lower ends, extends downwardly from the first end of the top wall and a second end wall, having upper and lower ends, extends downwardly from the second end of the top wall. A first side wall, having upper and lower ends, extends downwardly from the first side of the top wall and a second side wall, having upper and lower ends, extends downwardly from the second side of the top wall.

The top wall has at least a central recessed portion extending downwardly thereinto. The top wall also has a peripheral recess formed therein which defines a horizontally disposed shoulder at the upper end of the first end wall, the second end wall, the first side wall and the second side wall. An elongated and upstanding first rail extends upwardly from the top wall adjacent the first side of the top wall. The first rail has inner and outer sides. A protrusion extends outwardly from the outer side of the first rail. An elongated and upstanding second rail extends upwardly from the top wall adjacent the second side of the top wall with the second rail having inner and outer sides. The second rail has a protrusion which extends outwardly from the outer side of the second rail.

The first side wall has an opening formed therein adjacent the lower end thereof which is directly below the protrusion which extends outwardly from the first rail. The second side wall has an opening formed therein adjacent the lower end thereof which is directly below the protrusion which extends outwardly from the second rail.

A first elongated connector member, having upper and lower ends, extends outwardly from the first end wall adjacent the first side wall. A second elongated connector member, having upper and lower ends, extends outwardly from the first end wall adjacent the second side wall. A third elongated connector member, having upper and lower ends, extends outwardly from the second end wall adjacent the first side wall. A fourth elongated connector member, having upper and lower ends, extends outwardly from the second end wall adjacent the second side wall. The first connector member has a slot which faces towards the first side wall with the second connector member having a slot which faces towards the second side wall. The third connector member has a slot which faces away from the first side wall and the fourth connector member has a slot which faces away from the second side wall.

A horizontally disposed and elongated first support member extends between the first and second connector members adjacent the lower ends thereof. The first support member has an upwardly presented opening formed therein at the center length thereof. A horizontally disposed and elongated second support member extends between the third and fourth connector members adjacent the lower ends thereof. The second support member has a protrusion or finger extending outwardly therefrom at the center length thereof.

An identical riser may be stacked upon a lower riser with the protrusions of the first and second rails of the lower riser being snap-fitted into the openings formed in the lower ends of the first and second side walls of the upper riser.

In the stacked position, the lower ends of the first end wall, the second end wall, the first side wall and the second side wall of the upper riser rest upon the horizontally disposed shoulder at the upper ends of the first end wall, the second end wall, the first side wall and the second side wall respectively of the lower riser.

First and second identical risers may be secured together in a side-by-side manner whereby the second riser is secured to the first riser by securing the third and fourth connector members of the second riser to the first and second connector members of the first riser with the protrusion or finger on the second support member of the second riser being received by the upwardly presented opening in the first support member of the first riser.

It is therefore a principal object of the invention to provide an improved riser for furniture such as beds, desks and sofas.

A further object of the invention is to provide a furniture riser wherein identical risers may be stacked one upon the other with the risers being snap-fitted together.

A further object of the invention is to provide a furniture riser wherein identical risers may be secured together in a snap-fitted side-by-side manner to stabilize the risers.

A further object of this invention is to provide a riser of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
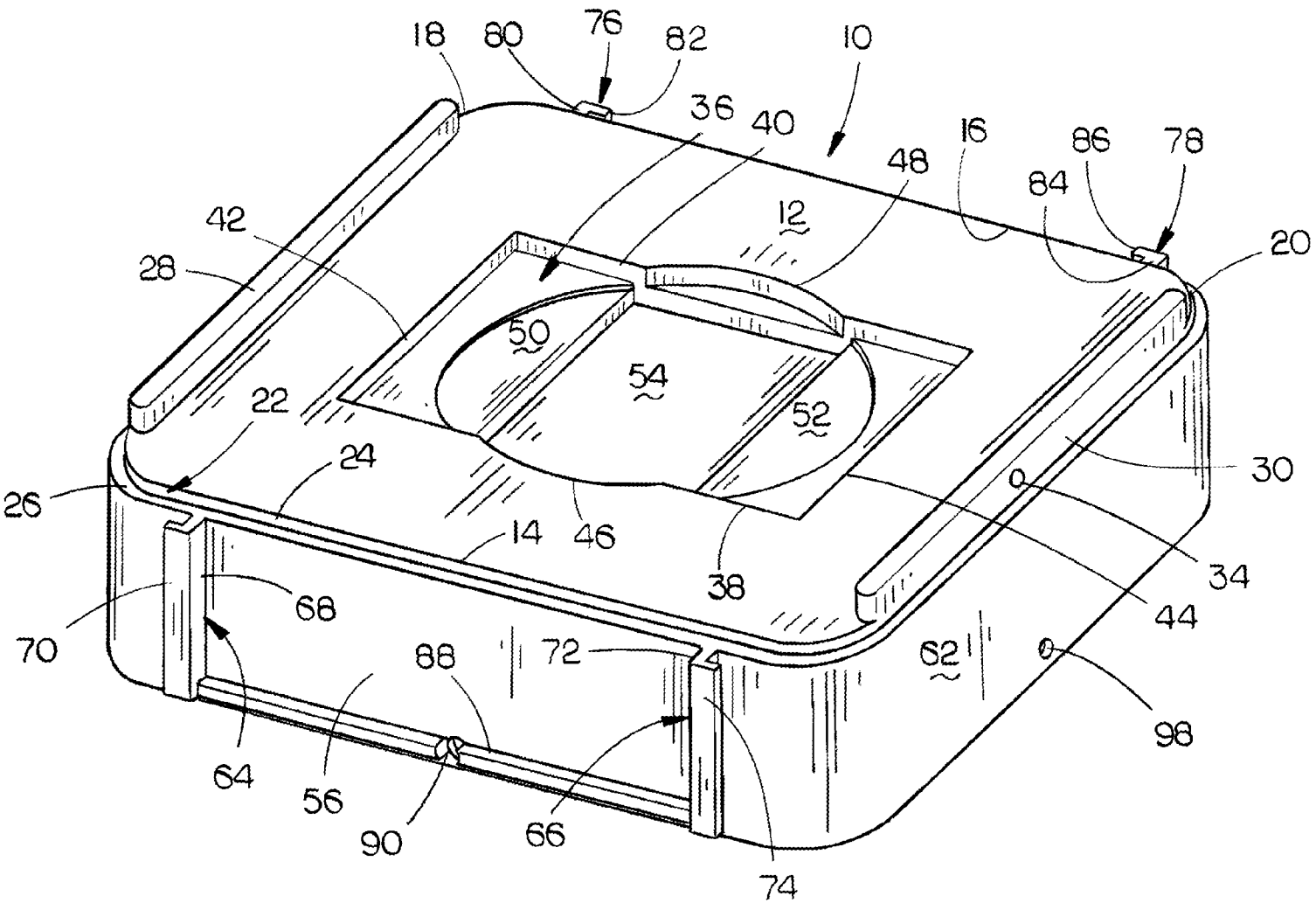
FIG. 1 is a top perspective view of the furniture riser of this invention.
Figure 2:
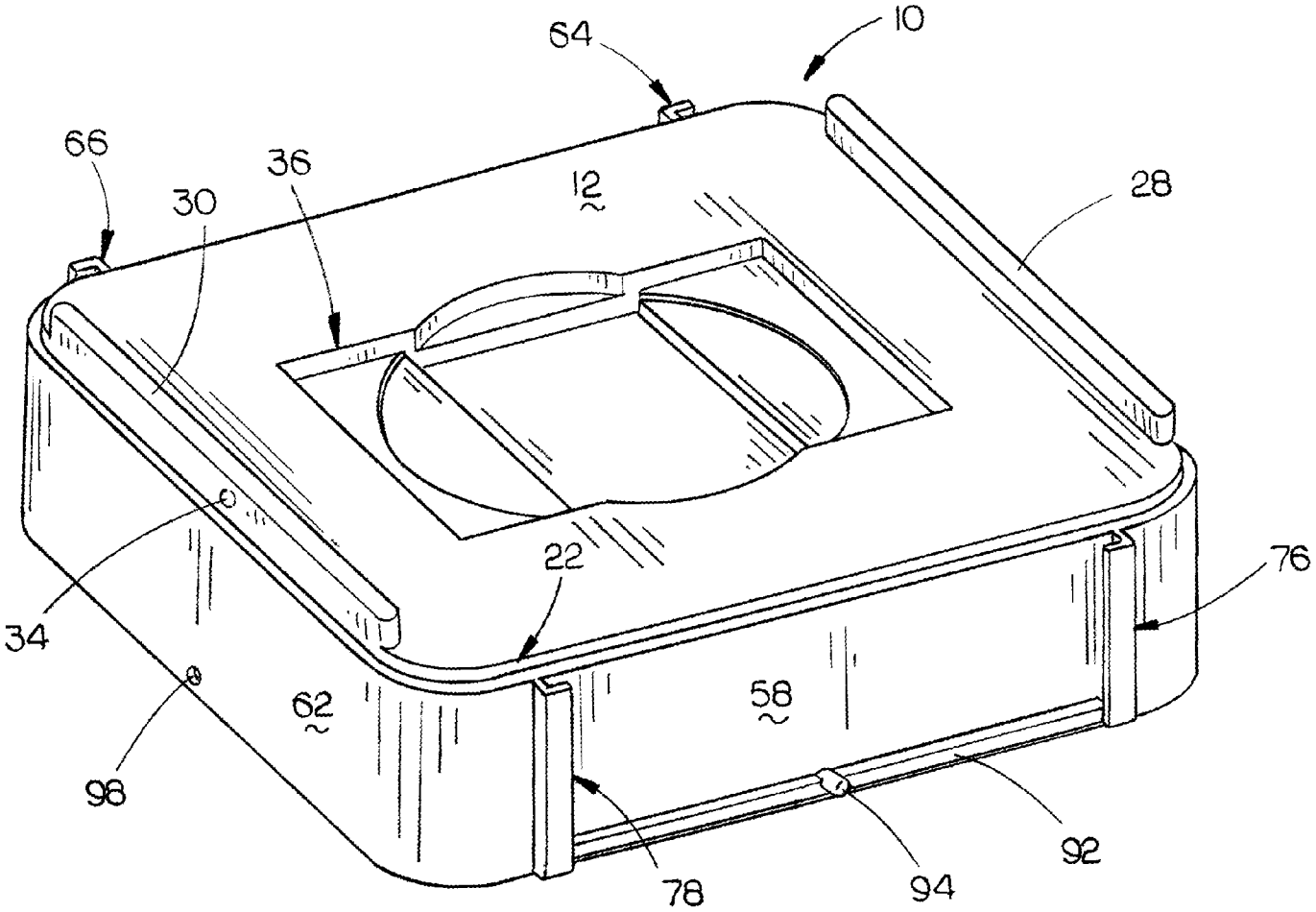
FIG. 2 is another upper perspective view of the furniture riser of this invention.
Figure 3:
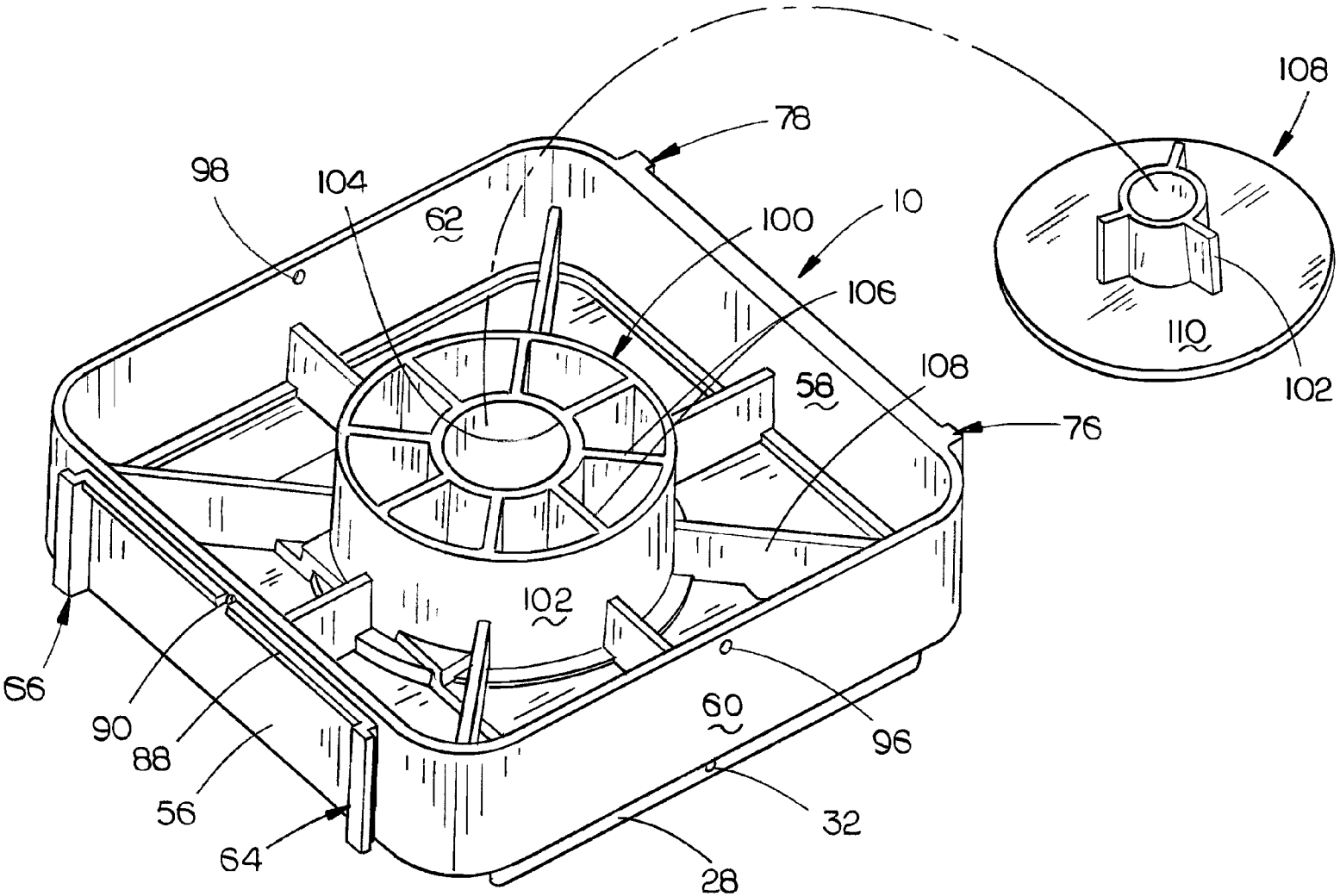
FIG. 3 is a bottom perspective view of the furniture riser of this invention.
Figure 4:
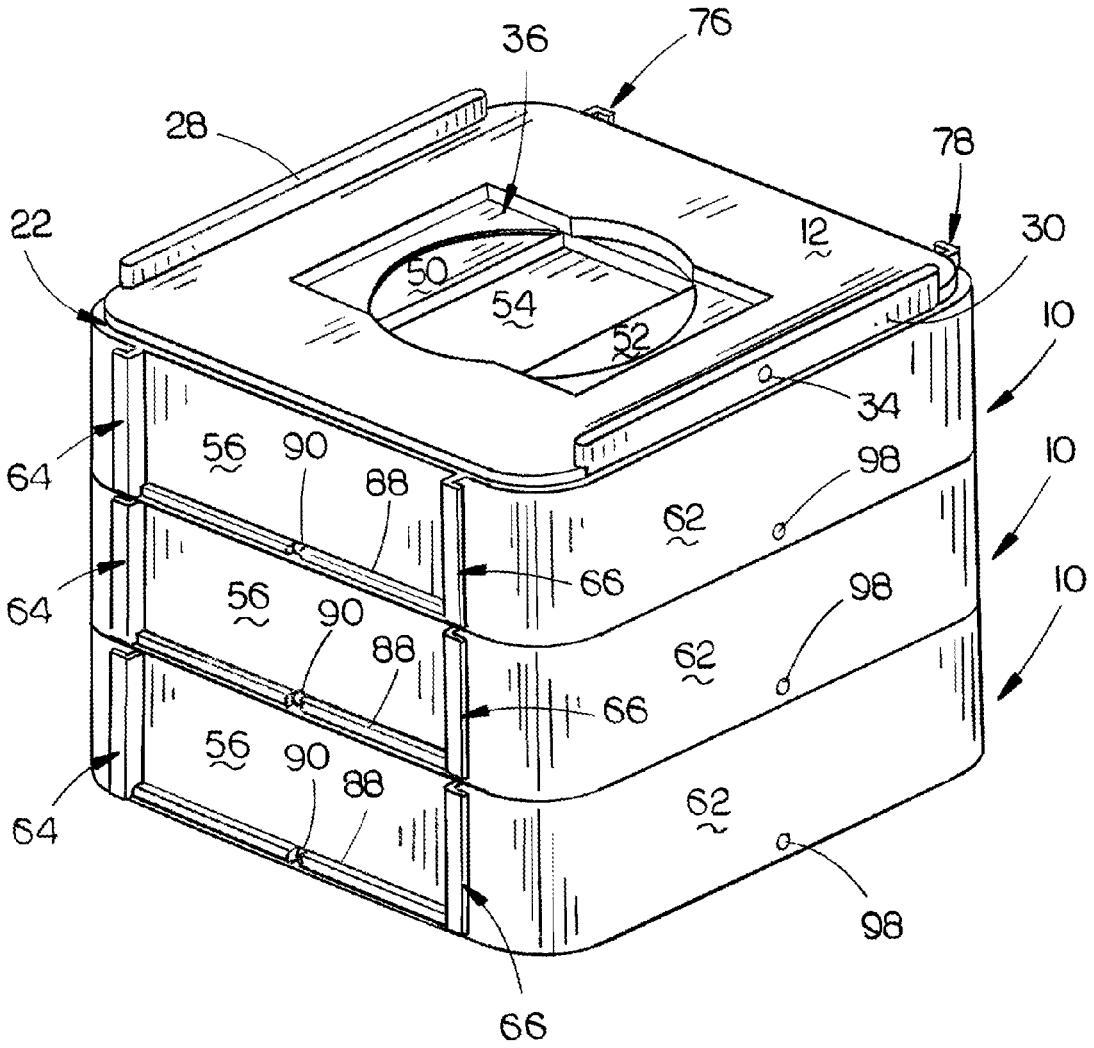
FIG. 4 is a perspective view illustrating two furniture risers being stacked upon one another.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the furniture riser of this invention which may be stacked one upon the other or secured in a side-by-side relationship with another identical riser 10 as will be described hereinafter. Riser 10 includes a horizontally disposed top wall 12 having a first end 14, a second end 16, a first side 18 and a second side 20. Preferably, top wall 12 is square in plan view but could be rectangular if so desired. As seen, the corners of top wall 12 are rounded. Riser 10 has a recessed portion 22 formed therein which extends around the periphery of the top wall with the recessed portion 22 including a side wall 24 and a shoulder 26 which extends horizontally outwardly from the lower end of the side wall 24.

An elongated and horizontally disposed rail 28 extends upwardly from top wall 12 at side 18 thereof. An elongated and horizontally disposed rail 30 extends upwardly from top wall 12 at side 20 of top wall 12. The outer surface of rail 28 has a nub or protrusion 32 extending outwardly therefrom at the center length thereof. The outer surface of rail 30 has a nub or protrusion 34 extending outwardly at the center length thereof. Top wall 12 has a first recessed portion 36 formed therein which extends downwardly thereinto and which has a first end 38, a second end 40, a first side 42, and a second side 44. The first end 38 of recessed portion 36 has a semi-circular portion 46 formed therein. The second end 40 of recessed portion 36 has a semi-circular portion 48 formed therein. Recessed portion 36 also has recessed portions 50 and 52 formed therein. Additionally, top wall 12 includes a recessed portion 54 formed therein.

Riser 10 has a first end wall 56 which extends downwardly from end 14 of top wall 12 and has a second end wall 58 which extends downwardly from end 16 of top wall 12. Riser 10 has a first side wall 60 which extends downwardly from side wall 18 of top wall 12 and has a second side wall 62 which extends downwardly from side 20 of top wall 12.

End wall 56 has a pair of horizontally spaced-apart and vertically disposed connector members 64 and 66 formed therein which extend outwardly therefrom. Connector member 64 includes a base portion 68 which extends transversely from end wall 56 and has a laterally extending wing portion 70 at the outer end thereof. Connector member 66 includes a base portion 72 which extends transversely from side wall 56 and has an outwardly extending wing portion 74 extending from the outer end thereof. As seen in the drawings, the wing portions 70 and 74 extend outwardly away from one another.

End wall 58 has a pair of horizontally spaced-apart and vertically disposed connector members 76 and 78 formed therewith which extend outwardly therefrom. Connector member 76 includes a base portion 80 which extends transversely outwardly from end wall 58 and has a wing portion 82 extending transversely from the outer end of base portion 80. Connector member 78 includes a base portion 84 which extends transversely outwardly from end wall 58 and which has a wing portion 86 extending transversely therefrom. As seen in the drawings, the wing portions 82 and 86 extend inwardly towards one another. The wing portions 70 and 74 of connector members define outwardly presented slots while wing portions 82 and 86 define inwardly presented slots.

End wall 56 has an elongated support 88 which extends outwardly from end wall 56 and which extends between connector members 64 and 66 at the lower ends thereof. An upwardly presented opening 90 is formed in support 88 at the center length thereof. Similarly, end wall 58 has an elongated support 92 formed therein which extends between the lower ends of connector members 76 and 78. Support 92 has a protrusion or finger 94 extending outwardly therefrom at the center length thereof. Side wall 60 has an opening 96 formed therein at the lower center length thereof. Side wall 62 has an opening 98 formed therein at the lower center length thereof.

The numeral 100 refers to a support structure which is positioned beneath top wall 12 between end wall 56, end wall 58, side wall 60 and side wall 62. Support structure 100 includes a cylindrical wall 102 which extends downwardly from the underside of top wall 12. A cylindrical wall 104 is positioned within wall 102 and is connected to cylindrical wall 102 by spokes 106. Support members 107 extend outwardly from wall 102 to the inside surface of walls 56, 58, 60 and 62. The entire support structure 100 is molded with the remainder of the riser. The numeral 108 refers to a rubber or plastic plug which includes a disc-shaped member 110 and a hub 112. Hub 112 is inserted into the cylindrical wall 104 so that member 110 engages the lower ends of spokes 106 and cylindrical wall 102.

The riser 10 is used as will now be described. If the riser 10 is going to be used in an unstacked position, risers 10 are placed beneath the lower ends or casters of the legs of the furniture. The lower ends of the furniture legs or casters thereon will be received by the recesses in the top wall 12 of the riser 10.

Figure 5:
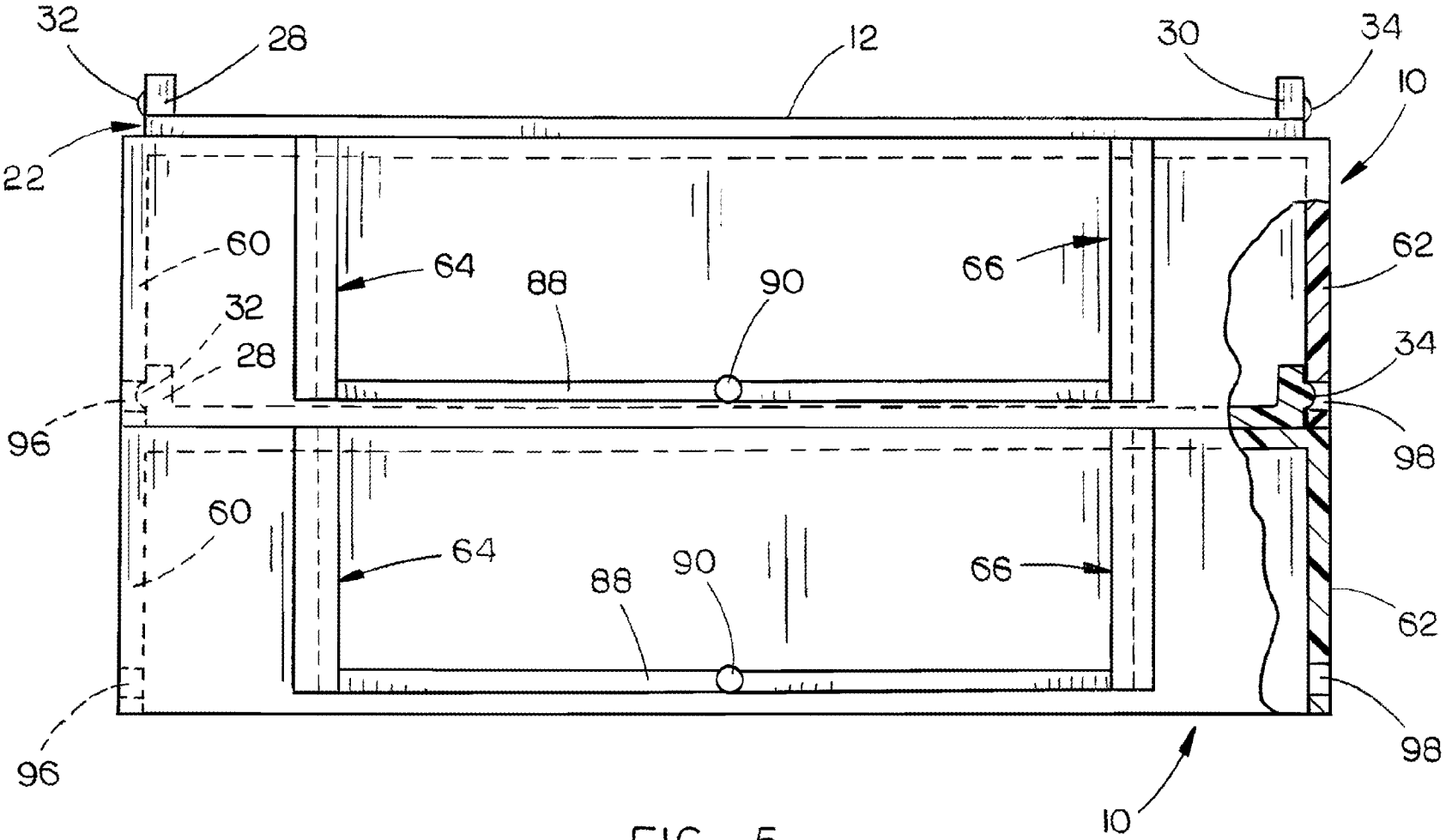
FIG. 5 is a side elevational view of two of the furniture risers of this invention stacked upon one another with a portion thereof cut-away to more fully illustrate the invention.
Figure 6:
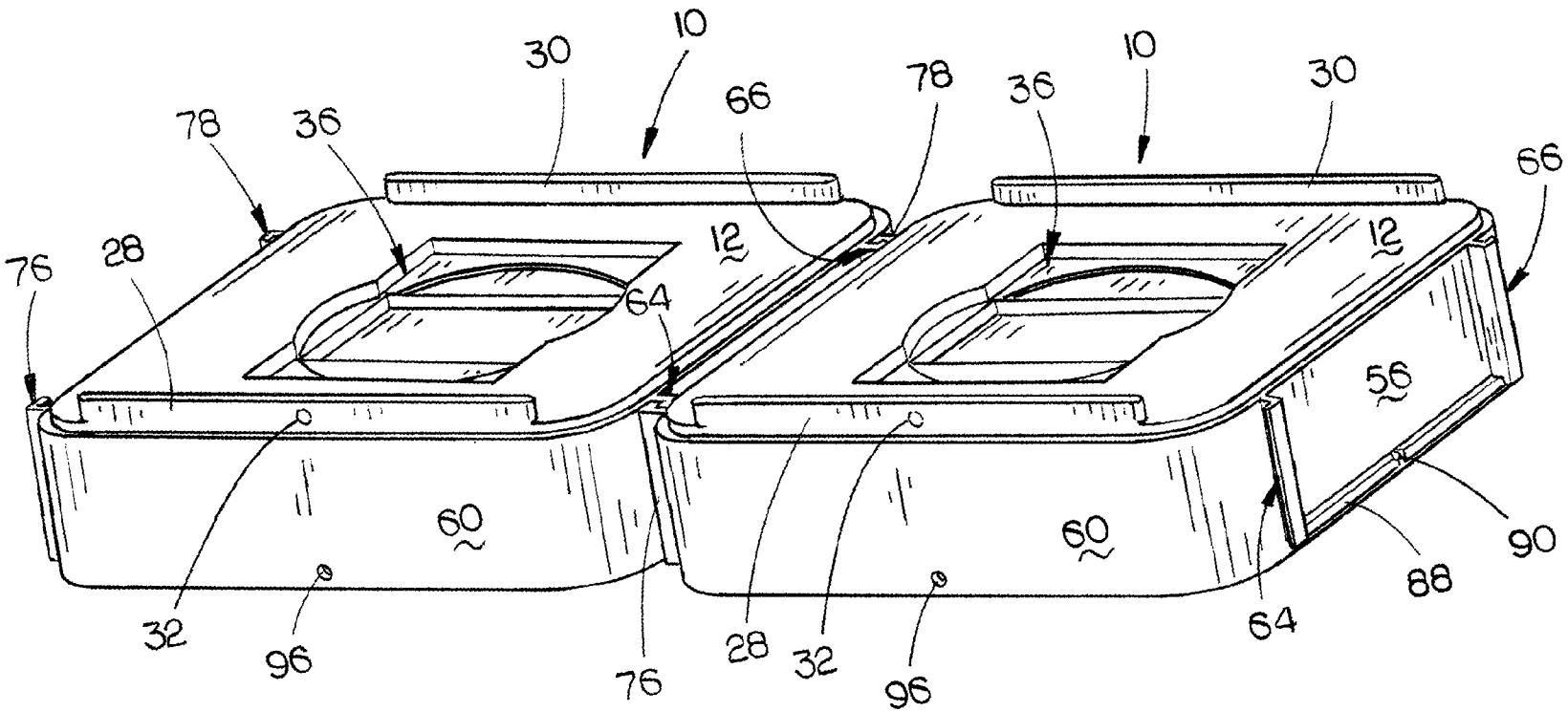
FIG. 6 is a perspective view of two of the furniture risers of this invention being secured together in a side-by-side manner.
Figure 7:
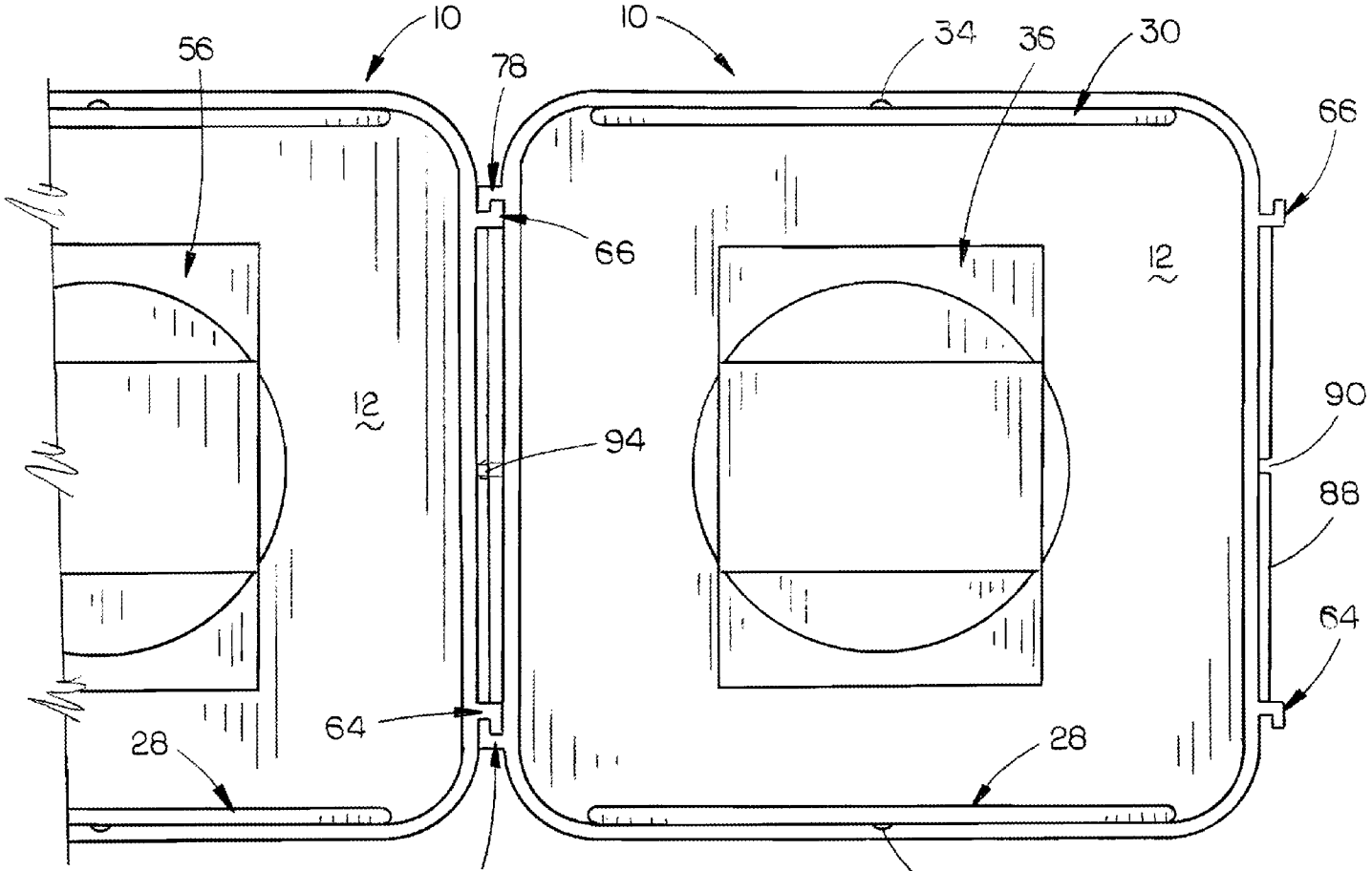
FIG. 7 is a partial top elevational view illustrating two of the furniture risers of this invention secured together in a side-by-side manner.

If the use of a single riser 10 does not elevate the furniture to the desired height, a second identical riser 10 may be stacked on a lower riser 10, as seen in FIG. 5, or three risers 10 may be stacked beneath each leg of the furniture. Assuming that only a second identical riser 10 is stacked upon a lower riser 10, as seen in FIG. 5, the uppermost riser 10 is positioned on the lower riser 10 so that the lower ends of the end wall 56, the end wall 58, the side wall 60 and the side wall 62 will be received by the recessed portion 22 on the lower riser 10 and will engage shoulder 26. In this position, the nubs or protrusions 32 and 34 on the rails 28 and 30 of the lower riser 10 will be snap-fitted into the openings 96 and 98 of the side walls 60 and 62 of the upper riser 10 respectively to stabilize the lower and upper risers 10. If it is desired to stabilize the riser 10 in the situation wherein the risers 10 are not stacked, a second riser 10 may be secured to a first riser 10, as seen in FIGS. 6 and 7. In that situation, the second riser 10 is rotated 180 degrees with respect to the first riser 10 so that connector members 76 and 78 of the second riser 10 may be connected to the connector members 64 and 68 respectively of the first riser 10 in the manner illustrated in the drawings so that the wing portions of the connector elements 76 and 78 on the second riser 10 are received by the slots in the connector members 64 and 66 of the first riser 10 respectively.

The side-by-side connection of the risers 10 is further stabilized by the fact that the protrusion 94 on support member 92 is received or snap-fitted into the opening 90 in support member 88. In the side-by-side connection, the support members 88 and 92 will be positioned in a side-by-side manner.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A furniture riser, comprising:

a horizontally disposed top wall having a first end, a second end, a first side and a second side;

a first end wall, having upper and lower ends, extending downwardly from said first end of said top wall;

a second end wall, having upper and lower ends, extending downwardly from said second end of said top wall;

a first side wall, having upper and lower ends, extending downwardly from said first side of said top wall;

a second side wall, having upper and lower ends, extending downwardly from said second side of said top wall;

said top wall having at least a central recessed portion extending downwardly thereinto;

said top wall having a peripheral recess formed therein which defines a horizontally disposed shoulder at said upper ends of said first end wall, said second end wall, said first side wall and said second side wall;

an elongated upstanding first rail extending upwardly from said top wall adjacent said first side of said top wall;

said outer side of said first rail having a protrusion extending outwardly therefrom;

an elongated upstanding second rail, having inner and outer sides, extending upwardly from said top wall adjacent said second side of said top wall;

said outer side of said second rail having a protrusion extending outwardly therefrom;

said first side wall having an opening formed therein adjacent said lower end thereof which is directly below said protrusion which extends outwardly from said outer side of said first rail;

said second side wall having an opening formed therein adjacent said lower end thereof which is directly below said protrusion which extends outwardly from said outer side of said second rail;

a first connector member, having upper and lower ends, extending outwardly from said first end wall;

a second connector member, having upper and lower ends, extending outwardly from said first end wall;

said first and second connector members being horizontally spaced-apart;

a third connector member, having upper and lower ends, extending outwardly from said second end wall;

a fourth connector member, having upper and lower ends, extending outwardly from said second end wall;

said third and fourth connector members being horizontally spaced-apart;

said first connector member having a slot which faces towards said first side wall;

said second connector member having a slot which faces towards said second side wall;

said third connector member having a slot which faces away from said first side wall;

said fourth connector member having a slot which faces away from said second side wall;

a horizontally disposed and elongated first support extending between said first and second connector members adjacent said lower ends thereof;

said first support having a U-shaped opening formed therein at the center length thereof;

a horizontally disposed and elongated second support extending between said third and fourth connector members adjacent said lower ends thereof;

said second support having a protrusion extending outwardly therefrom at the center length thereof.

2. The riser of claim 1 wherein an identical riser may be stacked upon a lower riser with the protrusions of the first and second rails of the lower riser being snap-fitted into the openings formed in the first and second side walls of the upper riser.

3. The riser of claim 2 wherein the lower ends of the first end wall, the second end wall, the first side wall and the second side wall of the upper riser rest upon the horizontally disposed shoulder at the upper ends of the first end wall, the second end wall, the first side wall and the second side wall respectively of the lower riser.

4. The riser of claim 1 wherein first and second identical risers may be secured together in a side-by-side manner, said second riser being secured to said first riser by securing the third and fourth connector members of the second riser to the first and second connector members of the first riser with the protrusion on the second support of the second riser being received by the U-shaped opening in the first support of the first riser.

5. A furniture riser, comprising:

a horizontally disposed top wall having a first end, a second end, a first side and a second side;

a first end wall, having upper and lower ends, extending downwardly from said first end of said top wall;

a second end wall, having upper and lower ends, extending downwardly from said second end of said top wall;

a first side wall, having upper and lower ends, extending downwardly from said first side of said top wall;

a second side wall, having upper and lower ends, extending downwardly from said second side of said top wall;

said top wall having at least a central recessed portion extending downwardly thereinto;

said top wall having a peripheral recess formed therein which defines a horizontally disposed shoulder at said upper ends of said first end wall, said second end wall, said first side wall and said second side wall;

an elongated upstanding first rail extending upwardly from said top wall adjacent said first side of said top wall;

said outer side of said first rail having a protrusion extending outwardly therefrom;

an elongated upstanding second rail, having inner and outer sides, extending upwardly from said top wall adjacent said second side of said top wall;

said outer side of said second rail having a protrusion extending outwardly therefrom;

said first side wall having an opening formed therein adjacent said lower end thereof which is directly below said protrusion which extends outwardly from said outer side of said first rail;

said second side wall having an opening formed therein adjacent said lower end thereof which is directly below said protrusion which extends outwardly from said outer side of said second rail;

a first connector member, having upper and lower ends, extending outwardly from said first end wall;

a second connector member, having upper and lower ends, extending outwardly from said first end wall adjacent said second side wall;

said first and second connector members being horizontally spaced-apart;

a third connector member, having upper and lower ends, extending outwardly from said second end wall;

a fourth connector member, having upper and lower ends, extending outwardly from said second end wall;

said third and fourth connector members being horizontally spaced-apart;

said first connector member having a slot which faces towards said first side wall;

said second connector member having a slot which faces towards said second side wall;

said third connector member having a slot which faces away from said first side wall;

said fourth connector member having a slot which faces away from said second side wall.

6. The riser of claim 5 wherein an identical riser may be stacked upon a lower riser with the protrusions of the first and second rails of the lower riser being snap-fitted into the openings formed in the first and second side walls of the upper riser.

7. The riser of claim 6 wherein the lower ends of the first end wall, the second end wall, the first side wall and the second side wall of the upper riser rest upon the horizontally disposed shoulder at the upper ends of the first end wall, the second end wall, the first side wall and the second side wall respectively of the lower riser.

8. The riser of claim 5 wherein first and second identical risers may be secured together in a side-by-side manner, said second riser being secured to said first riser by securing the third and fourth connector members of the second riser to the first and second connector members of the first riser.

* * * * *